US005863000A

United States Patent [19]

Gingras

[11] Patent Number: 5,863,000

[45] Date of Patent: Jan. 26, 1999

[54] REFINER PLATE WITH STEAM RELIEF POCKETS

[75] Inventor: Luc Gingras, Leeds, United Kingdom

[73] Assignee: Durametal Corporation, Tualatin, Oreg.

[21] Appl. No.: 886,612

[22] Filed: Jul. 1, 1997

[51] Int. Cl.[6] ..... B02C 7/12

[52] U.S. Cl. ..... 241/28; 241/261.2; 241/298

[58] Field of Search ..... 241/261.2, 261.3, 241/296, 297, 298, 28, 30

[56] References Cited

U.S. PATENT DOCUMENTS

| | | |
|---|---|---|
| 1,131,272 | 3/1915 | Reynolds . |
| 1,144,089 | 6/1915 | Alsted . |
| 1,368,609 | 2/1921 | Czarev . |
| 1,477,013 | 3/1923 | Snyder . |
| 3,040,997 | 6/1962 | Borden . |
| 3,240,437 | 3/1966 | Horstman . |
| 3,674,217 | 7/1972 | Reinhall . |
| 3,910,511 | 10/1975 | Leider et al. . |
| 3,974,971 | 8/1976 | Reinhall . |
| 4,676,440 | 6/1987 | Perkola . |
| 4,712,745 | 12/1987 | Leith . |
| 4,953,796 | 9/1990 | Virving . |
| 5,181,664 | 1/1993 | Kohler . |
| 5,373,995 | 12/1994 | Johannson . |

FOREIGN PATENT DOCUMENTS

| | | |
|---|---|---|
| 3432255 A1 | 3/1986 | Germany . |

*Primary Examiner*—Mark Rosenbaum
*Attorney, Agent, or Firm*—Alix, Yale & Ristas, LLP

[57] ABSTRACT

A refiner plate for the face of a refiner disc comprising a plurality of refiner segments arranged side-by-side on the face of the disc to form a substantially annular refining region. Each refiner segment has a plurality bars and grooves for refining a lignocellulosic material and a plurality of steam pockets for receiving, storing and transmitting steam generated during the refining process. Each steam pocket is defined by a series of gaps in adjacent bars such that the steam pocket extends radially and laterally across the refiner segment and such that the surface of the steam pocket is at or below the height of the groove surface. At least one bar extends radially between each adjacent steam pocket in a segment, thereby forming a discontinuous path for the movement of steam.

23 Claims, 5 Drawing Sheets

REFINER PLATE WITH STEAM RELIEF POCKETS

BACKGROUND OF THE INVENTION

The present invention relates generally to disc grinders for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. A large volume of steam is produced between the plates as a result of this refining work. For effective refining, the fibrous material must be retained between the plates on the bar surfaces despite the high velocity of the flowing steam, and the enormous centrifugal forces. Typically, the steam has been exhausted via the grooves, and dams have been provided in the grooves to interrupt material flow and thus improve the retention time of the material in the refining region.

In a typical refiner plate with radial bars and grooves, the bars provide impacts or pressure pulses which separate and fibrillate the fibers. The grooves enable feeding of the fibers and steam extraction. Near the perimeter of the plates, high radial steam flow and high centrifugal force both act to sweep the fibers outwardly from between the plates prematurely, thus reducing the refining effectiveness. The flow restrictions due to a small plate gap and fiber-filled grooves result in a steam pressure peak between the plates, located radially inward from the perimeter. This pressure peak is a major source of the refining thrust load, and can induce control instability at high motor loads.

It is thus desirable that the steam generated during refining be discharged from the refining region as quickly as possible, while retaining the pulp within the region as long as possible. Conventional refiner plates utilize a variety of mechanisms to promote the flow of steam while retarding the flow of pulp. U.S. Pat. No. 4,676,440 discloses refiner plates for mounting to the rotor, having a plurality of exhaust channels that extend continuously across the face of the grinding surface. The sectional area of each exhaust channel is greater than that of the grooves, promoting efficient exhaustion of the steam through the channel. Each channel is placed at an angle to impede the flow of particles through the channel. Edge formations or partial height dams in the channel may also be incorporated to control the amount or kind of material that can be carried by the steam flow.

SUMMARY OF THE INVENTION

Briefly stated, the invention in a preferred form is a refiner plate which is constituted from a plurality of refiner plate segments, each of the segments formed with a pattern including a plurality of radially disposed bars and grooves and a plurality of distinct steam pockets which extend radially and laterally across the segment. At least one bar extends radially between each steam pocket to ensure that the pockets do not define a continuous flow path.

Preferably, the refiner plates for both the stator and the rotor are composed of segments having steam pockets in accordance with the invention. As the rotor rotates, the steam pockets on the rotor plate at least partially overlap the steam pockets on the stator plate, allowing the steam to relocate from the steam pockets on one plate to the steam pockets on the other plate and thereby move radially out of the refiner.

It is an object of the present invention to provide a refiner plate for the face of a refiner disc, which facilitates the removal of steam while retaining the pulp in the refiner region to achieve satisfactory pulp quality.

This object is achieved by, in general, providing a discontinuous flow path. This flow path allows the removal of large quantities of steam while impeding the flow of the lignocellulosic material, thereby preventing the removal of unrefined or partially refined material. The number of steam pockets, the radial length of each steam pocket, and the overall size of each steam pocket determines the efficiency of steam evacuation.

Accordingly, the object of achieving good fiber quality with good steam management is accomplished by providing relatively high volume steam collection and storage pockets on the face of each refiner plate and requiring the steam to flow through a labyrinth defined by the steam pockets on both stator and rotor plates. To the inventor's knowledge, no one previously provided steam collection and storage pockets that also acted as a discontinuous flow path, to achieve an overall optimization according to the present invention.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
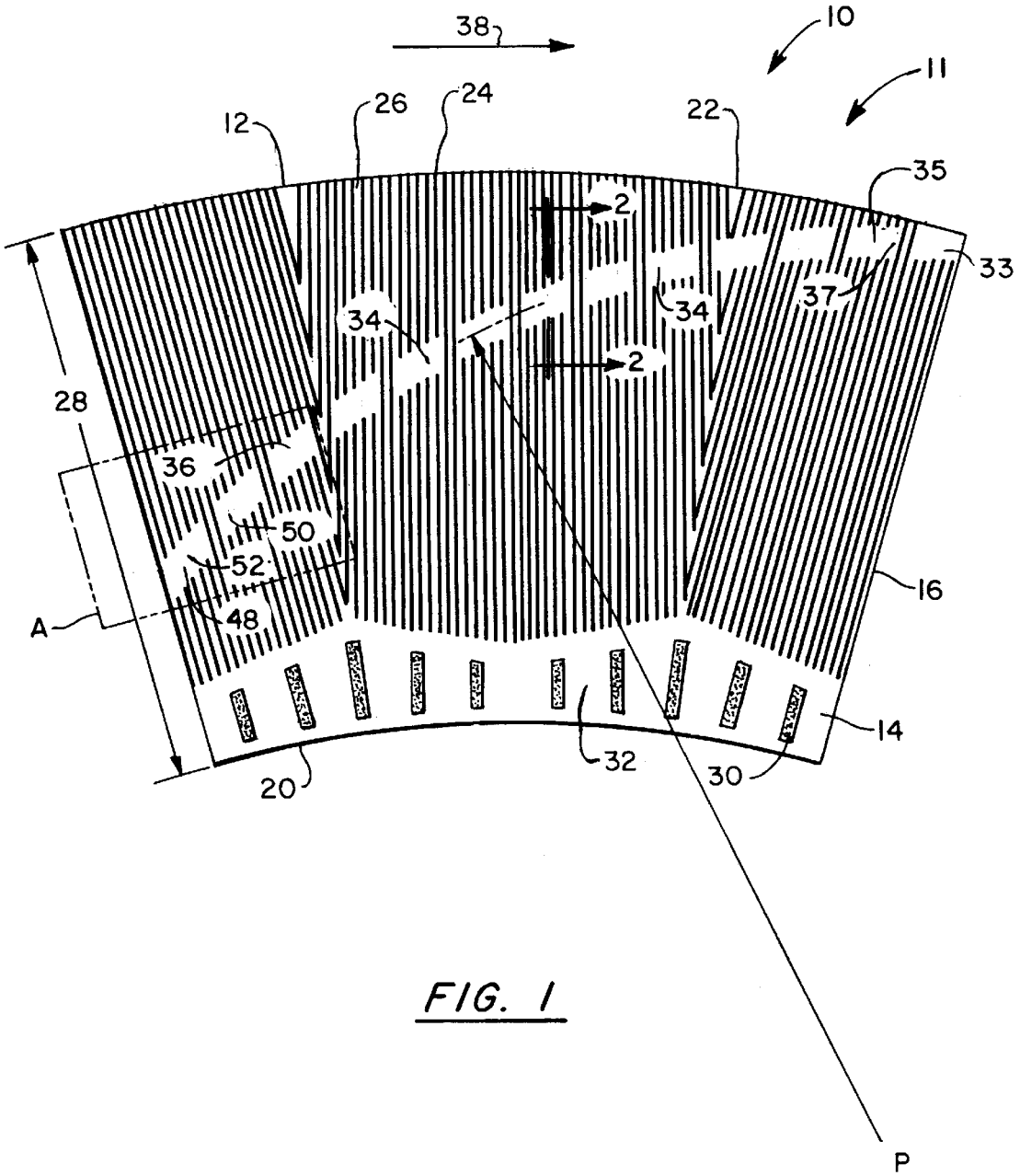
FIG. 1 is an elevation view of a rotor refiner plate segment in accordance with the invention.

With reference to the drawings wherein like numerals represent like parts throughout the several figures, a refiner plate in accordance with the present invention comprises a plurality of refiner plate segments 10, 10' which are securable to the front face of a substantially circular refiner disc 12. Although in the illustrated embodiment each segment has two zones 14, 16, each having a differently oriented set of patterns, each segment 10, 10' could alternatively have a single or three or more zones having respective sets of patterns.

The plate segments 10, 10' are attached to the disc face, in any convenient or conventional manner, such as by bolts (not shown) passing through bores. One end of the bolt engages the disc 12 and at the other end has head structure bearing against a countersunk surface. The disc 12, only a portion of which is shown, has a center about which the disc rotates, and a substantially circular periphery. The refiner plate segments 10 are arranged side-by-side on the face of the disc 12, to form a substantially annular refiner face, shown generally at 18. The face 18 forms a portion of a refiner region, when confronting another refiner plate (not shown) carried by another disc.

Each refiner plate segment 10, 10' has an inner edge 20 near the center of the disc, and an outer edge 22 near the periphery of the disc. The remainder of this description will refer to a single plate segment 10, 10', but it should be understood that all the segments which define the annular plate, are preferably substantially similar. The bars 24, 30 and grooves 26, 32 extend substantially radially, i.e., radially, or parallel to a radius of the disc 12, for example radius 28, or obliquely at an acute angle to such a radius. The plate segment 10 has, on its face, at least one, and preferably two or three distinct patterns of bars and grooves between the bars (FIG. 1), whereby material to be refined can flow in the grooves in the general direction from the inner edge 20 to the outer edge 22 of the plate segment.

With reference to FIG. 1, a first or inlet zone 14 has a multiplicity of bars 30 and grooves 32 between adjacent bars 30, all of which extend substantially in the radial direction. This pattern is especially adapted for receiving wood chips, wood pulp, or the like and performing an initial refining operation thereon to reduce the size of the material and funnel it radially outward into a second, refining zone 16, 16'. The refining zone has a multiplicity of bars 24 and grooves 26 between adjacent bars 24, which also extend in parallel, substantially radially. A third, outer zone (not shown) may be provided between the refining zone and the outer edge of the plate. As shown in FIG. 1, each zone 14, 16, 16' may comprise a plurality of fields, where each field has a uniform pattern. In the embodiment shown in FIG. 1, the segment has three fields in each zone. The patterns promote the flow of steam radially outward to the outer edge 22 of the disc 12 and radially inward to the inner edge 20 of the disc 12 for evacuation while retarding the flow of material to ensure that the material is fully refined.

Since the disc and plate rotate, the partially refined material is directed, as a result of centrifugal force, radially outward. Each groove 26 may have one or more dams in order to maintain this material in the refining zone 16 as long as possible. The dams interrupt or impede the flow of material through the grooves 26, forcing the material onto the adjacent bars 24 for further refining. Substantial quantities of steam are also generated in the refining zone 1 6 producing a steam flow with high radial velocity.

Especially with relatively large discs, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the disc face due to steam generated by the refining at high consistency. Since the pressure peak is between the Inner and outer edges 20, 22 of the plate, the steam flows forward (radially outward) from the outer side of the pressure peak and backward (radially inward) inside the pressure peak, against the material feed.

In the preferred embodiment of the invention, the stator and rotor refiner plates segments 10', 10 each include a plurality of steam pockets 34, 34' for the collection and transmittal of steam across the refiner plates. The pockets 34, 34' are staggered such that each steam pocket extends radially outward in addition to laterally across the segment 10, 10'. At least one bar 24 extends radially between each adjacent steam pocket 34, 34' in a segment 10, 10'. Consequently, the pockets 34, 34' on each segment 10, 10' of a refiner plate segment form a discontinuous path for the movement of steam and do not form a continuous channel. The lateral extension of the steam pockets 34, 34' may be limited, if required, without eliminating the steam transport capability. The reduction in efficiency of steam transport will be determined by the extent to which the lateral extension is limited.

FIG. 1 illustrates a segment 10 for a rotor plate 11 having steam pockets which extend in a substantially arcuate line from a point intermediate the junction of the inlet and refining zones 14, 16 to the outer edge 22 of the plate such that the arc formed by the steam pockets 34 has a substantially uniform radius from a point P. Each pocket 34, 34' has the shape of an arc segment where two sides 35 each extend laterally and radially and have substantially parallel arcuate shapes and two sides 37 each extend substantially on a radius of the segment 10. Preferably sides 35 have a length of 30 to 60 millimeters and sides 37 have a length of 10 to 25 millimeters. The segments 10' for the stator plate 13 (FIG. 4) are the same as the segments for the rotor plate with the exception of the radially outermost steam pocket 33', as described below. Alternatively, the pockets may define a single substantially straight line or a plurality of laterally and radially extending lines. The pockets may also be randomly distributed over the surface of the plate, providing they radially cover the entire surface of the plate.

As the rotor plate 11 and the stator plate 13 move relative to each other, the steam pockets 34, 34' on the rotor and stator plate segments 10, 10' define a maze or labyrinth path for the movement of the steam out of the refiner. In the embodiment shown in FIG. 1, each steam pocket 34 on the rotor plate segment 10 has a corresponding steam pocket 34' on the stator plate segment 10' such that the corresponding steam pockets are substantially mirror images of each other, i.e. they are positioned at substantially the same location on the segment and extend laterally and radially substantially the same distance.

Figure 5A:
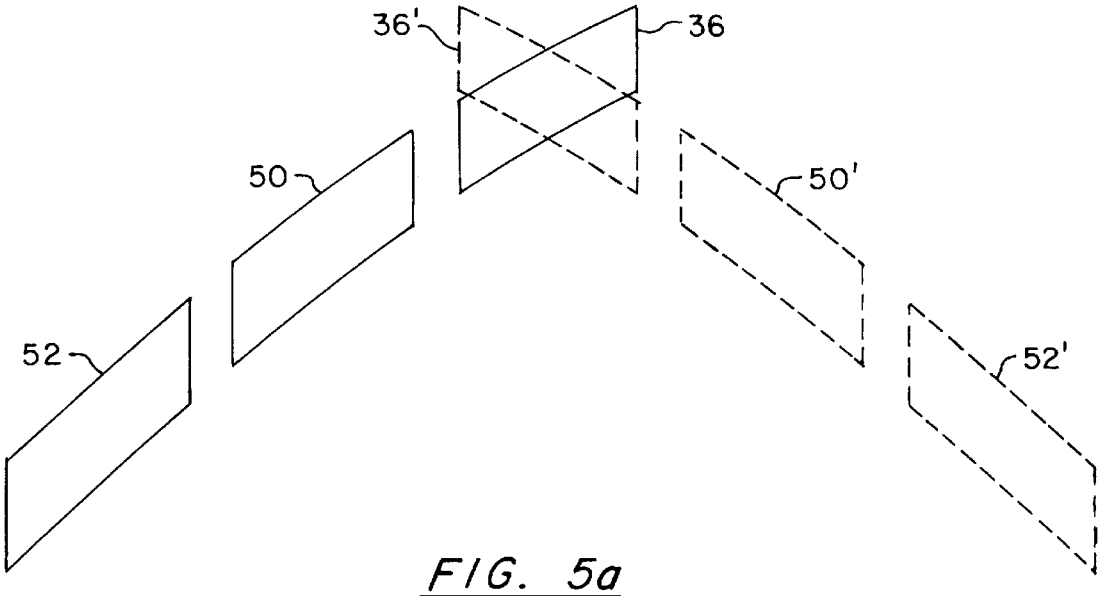
FIGS. 5*a*, 5*b*, 5*c* and 5*d* are enlarged schematic views of the steam pockets of section A of FIG. 1 and the steam pockets of section B of FIG. 4, where the steam pockets of section B are shown in phantom, illustrating the rotor rotated to four different positions.
Figure 5B:
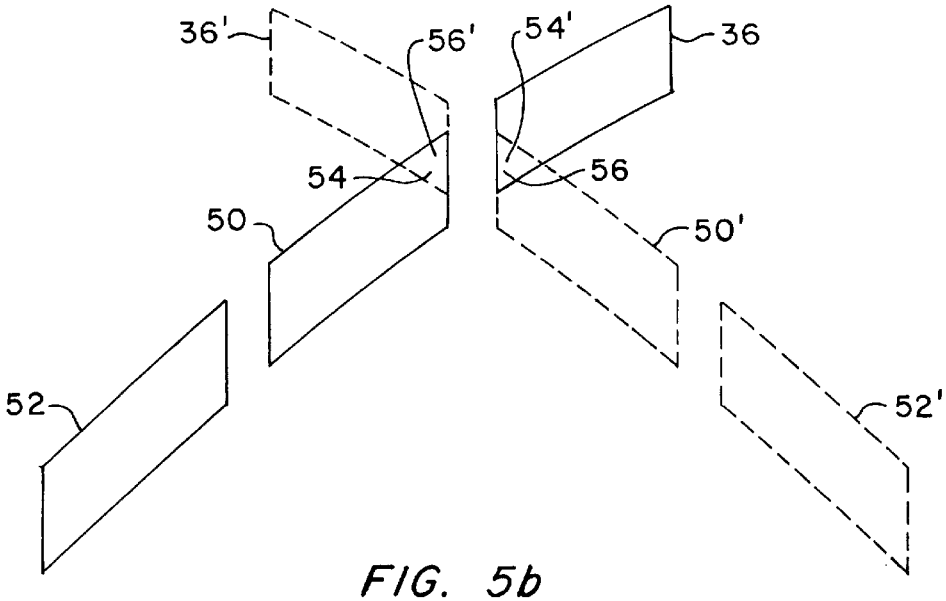
Figure 5C:
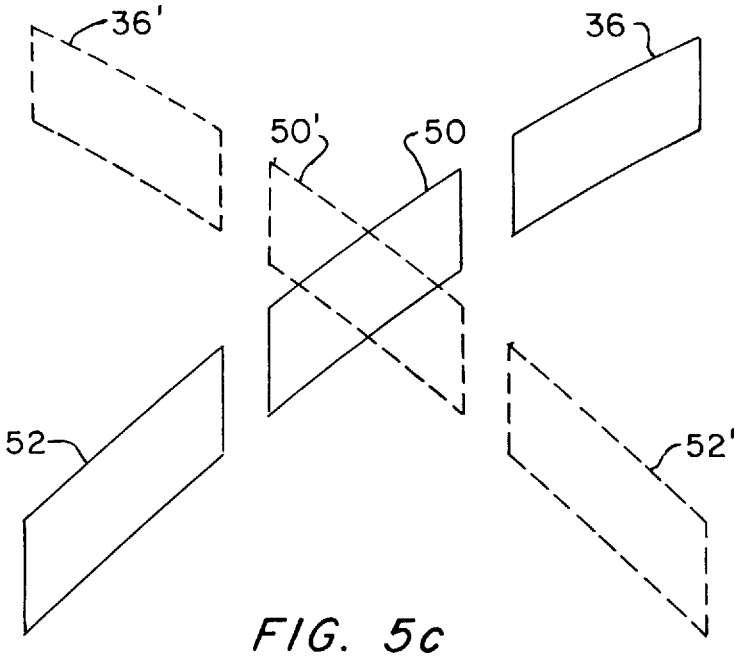
Figure 5D:
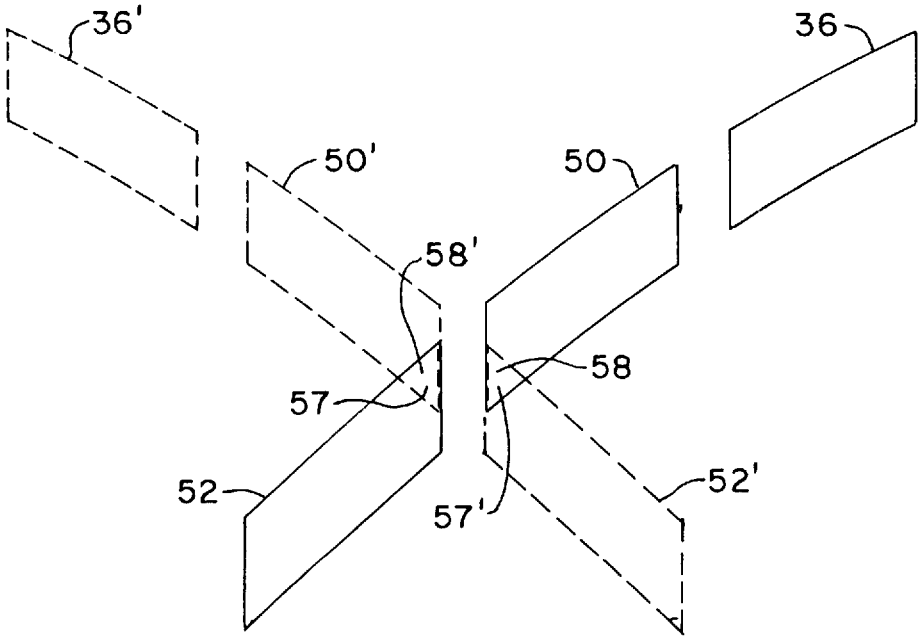

Preferably, rotation of the rotor plate 11 will initially move the radially outer steam pocket 36 on the rotor plate segment 10 to a position adjacent the radially outer steam pocket 36' on the stator plate segment 10', as shown in FIG. 5*a*. Continued rotation will move the outer steam pockets 36, 36' to a position where a portion 54, 54' of each steam pocket 36, 36' overlaps a portion 56', 56 of the next steam pocket 50', 50 on the opposite plate segment 10', 10, as shown in FIG. 5*b*. Continued rotation will move steam pockets 36, 36' to positions where they do not overlap any other steam pocket 34', 34 and steam pockets 50, 50' are adjacent, as shown in FIG. 5*c*. Continued rotation will move steam pockets 50, 50' to a position where a portion 57, 57' of each steam pocket 50, 50' overlaps a portion 58', 58 of the next steam pocket 52', 52 on the opposite plate segment 10', 10, as shown in FIG. 5*d*. It should be understood that as the relative rotation 30 between the stator plate 1 3 and the rotor plate 11 continues, each steam pocket 34, 34' on both plate segments 10, 10' will progressively, briefly, overlap the next radially inward steam pocket 34', 34 on the opposite plate segment 10', 10. Steam that has collected in the steam pockets 34, 34' relocates from the pocket located in the area of higher steam pressure to the pocket located in the area of lower steam pressure. Consequently, the steam relocates from the steam pockets 34, 34' on one plate 10, 10' to the steam pockets 34', 34 on the other plate 10', 10 to move radially from an area of high steam pressure to an area of lower steam pressure.

Alternatively, pockets 50 or 50' on one plate segment 10, 10' may overlap more than one pocket 36', 52' or 36, 52 on the opposite plate segment 10', 10.

It should be appreciated that the steam pockets 34, 34' will also facilitate movement of the steam if the rotor rotates in the direction opposite to arrow 38. Such rotation will cause the steam pockets 34, 34' to progressively overlap from the innermost steam pocket 48, 48' to the outermost steam pocket 36, 36'. However, the preferred sequence of overlap, outermost-to-innermost, provides greater refiner efficiency since it forces the steam to flow against the rotation of the disc. Such action forces more fibers into the grooves that extend into the pockets.

The radially extending shape of the steam pockets 34, 34' allows the steam in each pocket to move partially radially outward or inward without excessive restriction. Consequently, there are no dams or other such protuberances disposed in the steam pockets. The discontinuous path of the steam pockets 34, 34' on each refiner plate, coupled with the transfer of steam from the pockets 34, 34' on one of the refiner plates to the pockets 34, 34' on the other refiner plate retards movement of the lignocellulosic material, thereby preventing material from exiting the refiner without having being sufficiently refined. The number of steam pockets 34, 34', the radial length of each steam pocket, and the overall size of each steam pocket determines the efficiency of steam evacuation.

Figure 4:
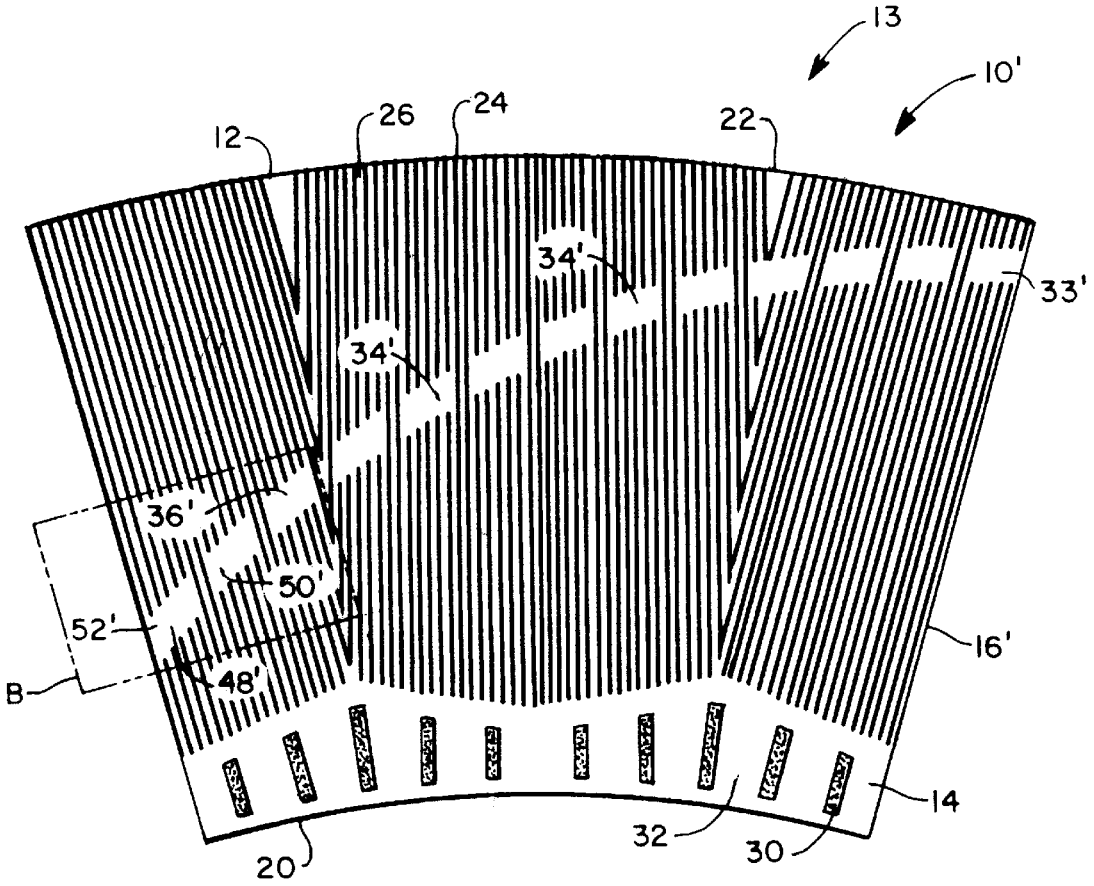
FIG. 4 is an elevation view of a stator refiner plate segment in accordance with the invention.

The radially outermost steam pocket 33 on rotor plates 1 0 may extend to the outer edge 22 of the plate, as shown in FIG. 1, or a plurality of bar segments may extend radially between the pocket and the outer edge 22 of the plate such that the pocket 33 does not extend to the outer edge 22 of the plate, as shown in FIG. 4. It has been found that an excessive amount of material is blown out of stator plate steam pockets 34' that extend to the outer edge 22 of the plate. Consequently, the radially outermost steam pocket 33' on stator plates 10' in accordance with the invention may not extend to the outer edge 22 of the plate. Any steam pocket 33 that extends to the outer edge 22 of the plate should do so at an angle to the direction of rotation 38 of the disc to retain material in the refining zone.

Figure 2:
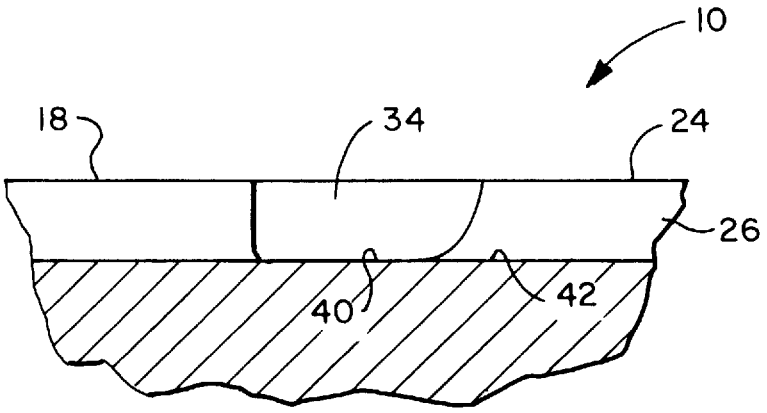
FIG. 2 is an enlarged section view along line 2—2 of FIG. 1.
Figure 3:
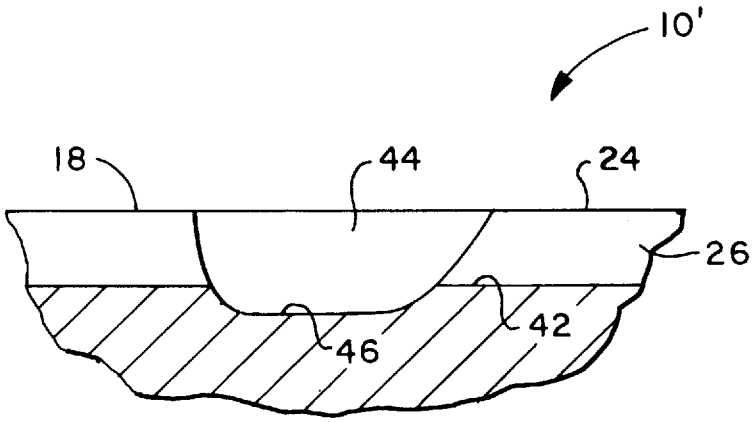
FIG. 3 is an section view similar to FIG. 2 of an alternate embodiment of a refiner plate in accordance with the invention.

Each steam pocket 34, 34' is defined by a series of gaps in five adjacent bars 24 such that the base surface 40 of the steam pockets 34, 34' are at the same depth as the surface 42 of the grooves 26, as shown in FIG. 2. In addition to the gaps in the bars 24, the steam pocket 44 may extend below the surface 42 of the groove 26, as shown in FIG. 3. In this embodiment the surface 46 of the steam pocket 44 is below the surface 42 of the groove 26, providing additional volume for the accumulation of steam without the removal of additional bar material. The steam pockets 34, 34', 40 may be formed by removing portions of the bar or portions of the bar and plate or by other conventional means.

A single refiner plate having steam pockets in accordance with the invention may be used in combination with a conventional refiner plate. The refiner plate having steam pockets may be used on either the stator or the rotor. The steam pockets operate with the grooves of both refiner plates to transport the stream generated within the refiner.

While preferred embodiments have been shown and described, various modifications and substitutions may be made thereto without departing from the spirit and scope of the invention. For example, the present Invention may also advantageously Implemented on a three zone segment. Also, the pockets may be positioned in the transition zone between two refining zones. Accordingly, it is to be understood that the present invention has been described by way of illustration and not limitation.

What is claimed is:

1. A refiner plate segment for refining lignocellulosic material, comprising a plurality of substantially radially disposed bars, a plurality of substantially radially disposed grooves alternating with said bars, and a plurality of pockets, each of said pockets extending radially across a portion of said refiner plate segment wherein at least one bar radially extends between each of said pockets and an adjacent said pocket, said pockets defining at least one discontinuous line.

2. The refiner segment of claim 1 wherein each of said pockets defines a gap in at least one of said bars.

3. The refiner segment of claim 2 wherein each of said pockets defines a gap in a plurality of adjacent bars.

4. The refiner segment of claim 1 wherein each of said grooves defines a base having a depth relative to the bars and each of said pockets defines a bottom having a depth relative to the bars, wherein said depth of said pockets is substantially equal to said depth of said grooves.

5. The refiner segment of claim 1 wherein each of said grooves defines a base having a depth relative to the bars and each of said pockets defines a bottom having a depth relative to the bars, wherein said depth of said pockets is greater than said depth of said grooves.

6. The refiner segment of claim 1 wherein said pockets define a substantially arcuate discontinuous line.

7. The refiner segment of claim 6 wherein each of said pockets defines an arc segment having a pair of laterally extending sides and a pair of radially extending sides, said laterally extending sides each having an arcuate shape.

8. The refiner segment of claim 7 wherein said laterally extending sides are substantially parallel.

9. The refiner segment of claim 1 wherein there is only one line of pockets in said segment.

10. The refiner segment of claim 1 wherein there are no dams in any of said pockets.

11. The refiner segment of claim 1 wherein at least two of said bars extend between each of said pockets and an adjacent said pocket.

12. The refiner segment of claim 1 wherein said segment has a radially outer edge and wherein said pockets include a radially outermost pocket which extends to said outer edge.

13. The refiner segment of claim 12 wherein said segment is rotatable in a direction of rotation and wherein said radially outermost pocket extends at an angle to said direction of rotation.

14. The refiner segment of claim 1 wherein said segment has a radially outer edge and wherein said pockets include a radially outermost pocket, wherein a portion of at least one bar is disposed radially intermediate said radially outermost pocket and said outer edge.

15. A refiner having relatively rotating opposed discs which carry plates formed by a plurality of segments for refining lignocellulosic material, the refining generating steam, wherein each segment comprises a pattern including a plurality of substantially radially extending bars and a plurality of substantially radially extending grooves disposed intermediate said bars, each segment of at least one of said plates further including a plurality of pockets, each of said pockets extending radially and laterally across a portion of said refiner plate segment and at least one bar radially extending between each of said pockets and an adjacent said pocket to separate said pockets, wherein steam and material may not pass from a said pocket to the adjacent pocket without passing over said bar.

16. The refiner of claim 15 wherein one of said discs defines a stator disc including an outer edge and each of said segments of said plate of said stator disc include a plurality of pockets, one of said pockets of each of said segments defining a radially outermost pocket, a portion of at least one bar being disposed intermediate said outermost pocket and said outer edge.

17. The refiner of claim 15 wherein one of said discs defines a rotor disc including an outer edge and each of said segments of said plate of said rotor disc include a plurality of pockets, one of said pockets of each of said segments defining a radially outermost pocket, a portion of at least one of said bars being disposed radially intermediate said outermost pocket and said outer edge.

18. The refiner of claim 15 wherein one of said discs defines a rotor disc including an outer edge and each of said segments of said plate of said rotor disc include a plurality of pockets, one of said pockets of each of said segments defining a radially outermost pocket, said outermost pocket extending to said outer edge.

19. The refiner of claim 18 wherein said rotor disc is rotatable in a direction of rotation and wherein said radially outermost pocket extends at an angle to said direction of rotation.

20. The refiner of claim 15 wherein at least one of said discs rotates and each of said pockets of said one of said discs at least partially overlaps at least one of said pockets of the other of said discs each rotation.

21. A method for removing steam, generated between a pair of relatively rotating opposed refining discs, during refining of a lignocellulosic material in a refiner, each of the discs having radially inner and outer edges and a face pattern including a plurality of substantially radially extending bars and a plurality of substantially radially extending grooves disposed intermediate the bars, the face pattern of at least one of the discs further including a plurality of steam pockets separated from each other by at least one bar for receiving the generated steam, wherein steam and material may not pass from a said pocket to an adjacent pocket without passing over said bar, the steam producing a distribution of steam pressure having a maximum pressure intermediate the inner and outer edges and minimum pressures at the inner and outer edges, the method comprising the steps of 1) transferring steam in one of the steam pockets at a relatively high pressure on one of the discs to another steam pocket at a relatively low pressure on said one disc, by sequentially exposing said one pocket and said other pocket to a particular portion of the pattern on the face of the other disc; and 2) repeating step 1 until the steam is transferred to the inner edge or the outer edge and thereby removed from between the discs.

22. The method of claim 21 wherein the pattern of both of the discs includes a plurality of steam pockets and the steam is transferred from the one steam pocket on the one disc to a steam pocket in the pattern of the other disc and from the steam pocket in the pattern of the other disc to another steam pocket on the one disc.

23. The method of claim 21 wherein the pattern of the other disc does not include any steam pockets and the steam is transferred from the one steam pocket on the one disc to the grooves in the pattern of the other disc and from the grooves in the pattern of the other disc to the other steam pocket on the one disc.

* * * * *